US007845025B2

(12) United States Patent
Tovo

(10) Patent No.: US 7,845,025 B2
(45) Date of Patent: Dec. 7, 2010

(54) EXIGENT HELMET RELEASE SYSTEM

(76) Inventor: Joseph R. Tovo, 366 Scott Ave., Glen Ellyn, IL (US) 60137

( * ) Notice: Subject to any disclaimer, the term of this patent is extended or adjusted under 35 U.S.C. 154(b) by 123 days.

(21) Appl. No.: 11/419,544

(22) Filed: May 22, 2006

(65) Prior Publication Data

US 2007/0266480 A1 Nov. 22, 2007

(51) Int. Cl.
*A63B 71/10* (2006.01)

(52) U.S. Cl. ..... 2/425; 2/411; 2/410

(58) Field of Classification Search ..... 2/425, 2/410, 413, 468, 411, 421, DIG. 3, DIG. 10
See application file for complete search history.

(56) References Cited

U.S. PATENT DOCUMENTS

| | | | | |
|---|---|---|---|---|
| 544,832 | A | 8/1895 | Senior | |
| 606,379 | A | 6/1898 | Dallinger | |
| 2,861,272 | A | 11/1958 | Stuart et al. | |
| 3,943,571 | A | 3/1976 | Boatman | |
| 3,990,757 | A | 11/1976 | Gill | |
| 4,291,418 | A | 9/1981 | Zeisler | |
| 4,317,239 | A * | 3/1982 | Bryksa | 2/411 |
| 4,477,929 | A | 10/1984 | Mattsson | |
| 4,573,222 | A | 3/1986 | Zago | |
| 4,660,230 | A | 4/1987 | Mayling | |
| 4,665,569 | A | 5/1987 | Santini | |
| 4,903,346 | A | 2/1990 | Reddemann et al. | |
| 4,955,089 | A | 9/1990 | Beale | |
| 4,985,938 | A | 1/1991 | Snow, Jr. | |
| 5,515,546 | A * | 5/1996 | Shifrin | 2/410 |
| 5,787,513 | A | 8/1998 | Sharmat et al. | |
| 6,154,889 | A * | 12/2000 | Moore et al. | 2/418 |
| 6,237,161 | B1 | 5/2001 | Lee | |
| 6,418,564 | B1 | 7/2002 | Sheridan | |
| 7,096,513 | B1 * | 8/2006 | Kress | 2/410 |

FOREIGN PATENT DOCUMENTS

| | | |
|---|---|---|
| DE | 29 01 088 A1 | 7/1980 |
| DE | 29915066 U1 * | 3/2000 |

* cited by examiner

*Primary Examiner*—Shaun R Hurley
*Assistant Examiner*—Andrew Sutton
(74) *Attorney, Agent, or Firm*—Michael P. Mazza, LLC

(57) ABSTRACT

A helmet which may be rapidly disassembled and removed from a wearer. A flexible cable may engage cable fastening elements located along a helmet split area, thereby forming the outer shell into an integral, rigid unit. When desired, the cable may be quickly withdrawn from the cable fastening elements so that the outer shell may be rapidly disassembled and removed from the wearer. Following disassembly, the helmet may be rapidly reassembled by reengagement with the cable fastening elements. Each end of the cable may be provided with a handle, to facilitate helmet disassembly whether the wearer of the helmet is lying substantially face-down or substantially face-up. A cable release mechanism may be provided to prevent unauthorized or undesired helmet disassembly during play, for example.

13 Claims, 2 Drawing Sheets

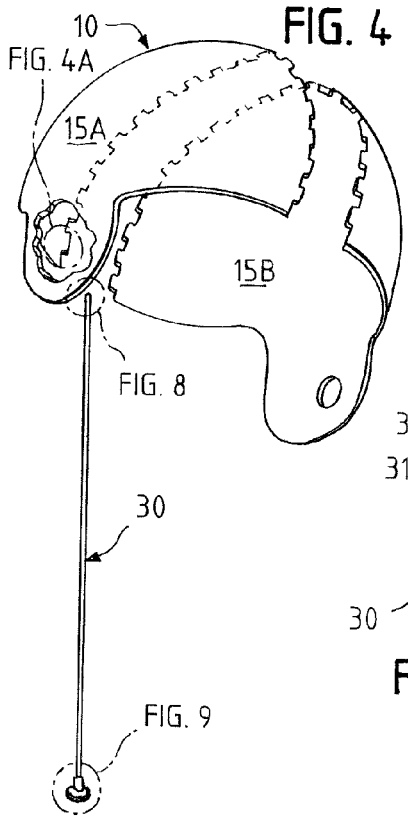
FIG. 4
10
FIG. 4A
15A
15B
FIG. 8
30
FIG. 9
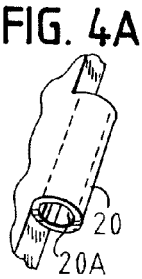
FIG. 4A
20
20A
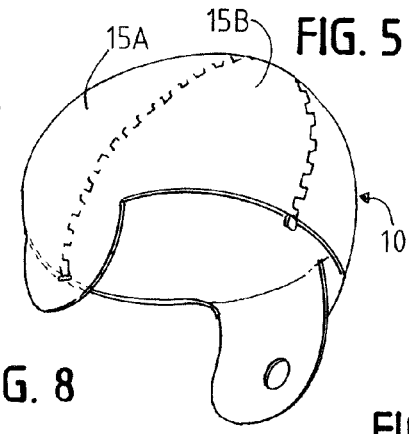
FIG. 5
15A
15B
10
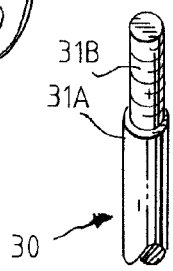
FIG. 8
31B
31A
30
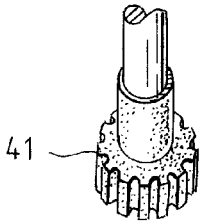
FIG. 9
41
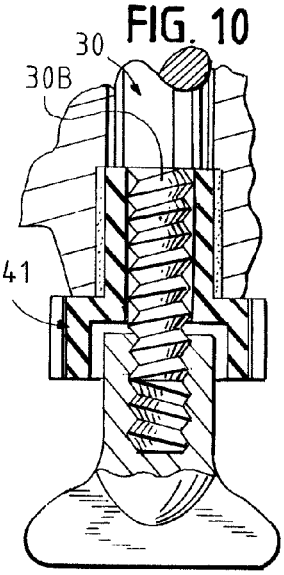
FIG. 10
30
30B
41
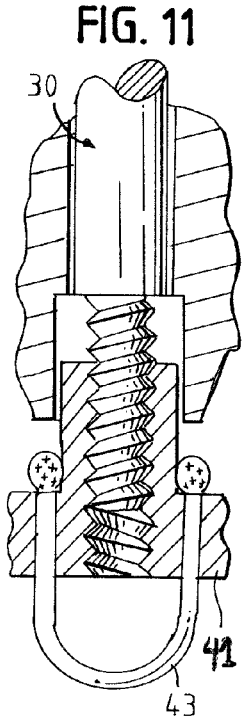
FIG. 11
30
41
43
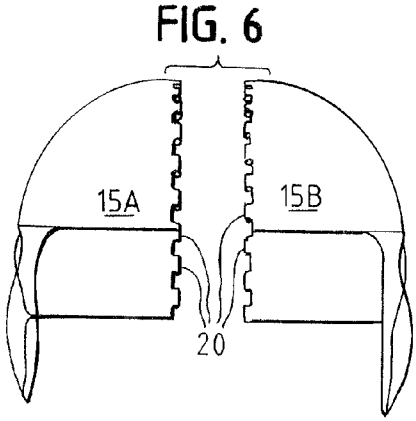
FIG. 6
15A
15B
20
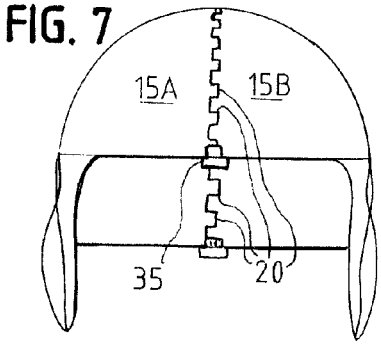
FIG. 7
15A
15B
35
20
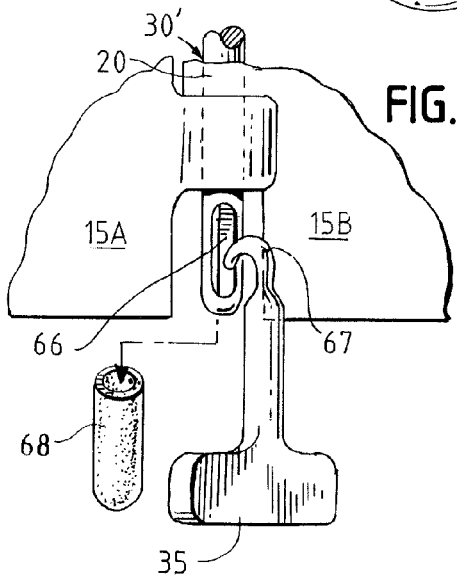
30'
20
FIG. 12
15A
15B
66
67
68
35

EXIGENT HELMET RELEASE SYSTEM

BACKGROUND OF THE INVENTION

The present invention relates to the field of helmets. More specifically, the invention relates to a helmet release system for use in situations requiring or potentially requiring rapid medical and/or emergent attention.

Many different types of helmets have been developed for the protection of those engaged in such disparate activities as auto and motorcycle driving and racing, football, hockey, lacrosse, rugby, etc. While many such helmets provide effective protection against impact, there is a need to provide a helmet which may be quickly and easily removed from the head without imparting additional injuries, particularly in cases where substantial injuries have been sustained and head and neck stabilization is paramount. It would also be beneficial to provide a removable helmet which may be relatively easily and economically manufactured, which is not releasable inadvertently or through mischievous play, and which is capable of being reused following its removal in exigent circumstances.

SUMMARY OF THE INVENTION

The objects mentioned above, as well as other objects which will be apparent on reading this disclosure to those of ordinary skill in the art, are achieved by the present invention, which overcomes disadvantages of prior helmet release systems, while providing new advantages not previously obtainable with such systems.

In one preferred embodiment, a helmet is provided which may be rapidly disassembled and removed from a wearer, and then immediately reused. The helmet may include an outer shell split along at least one axis which traverses a substantial surface length of the shell. The shell may include mating guide elements along the split area. A flexible cable is also provided for engaging cable fastening elements positioned along the split area, so that when the cable engages the cable fastening elements, the outer shell is formed into an integral, rigid unit. The cable may be quickly disengaged from the cable fastening elements so that the outer shell may be rapidly disassembled and removed from the wearer and, following disassembly, the cable may reengage the cable fastening elements so that the outer shell may be rapidly reassembled.

The cable may include one handle. Preferably the cable has a handle at each end, allowing rapid helmet disassembly whether the wearer of the helmet is lying substantially face-down or substantially face-up. For safety during play, the handle may be covered with plastic or rubber, for example. The handle may be rigidly connected to the cable using a cable release mechanism, operable by the use of a key. The cable release mechanism may include a locking element designed to allow the handle to be rigidly connected to an end of the cable upon operation of the key, and which also permits the handle to be released from the cable upon operation of the key.

In one embodiment, the helmet may include a resilient, padded inner liner attached adjacent to the outer shell. The outer shell may include two or more separate portions, and the liner may be of two or more separate pieces, with each liner piece sized and shaped to line a separate, corresponding portion of the outer shell. The helmet may be split along an axis which forms the helmet into two side portions or, alternatively, along an axis which forms the helmet into front and rear portions or, alternatively, along other another substantial lateral or longitudinal axis.

In one preferred embodiment, the cable fastening elements include hollow, generally cylindrical-shaped elements spaced along the split area, and positioned so that fastening elements located on opposing sides of the split area lie adjacent to each other when the helmet is assembled.

In an alternative embodiment, the handle may be selectively connected to the cable, enabling withdrawal and release of the cable from the helmet, such as by using a hook insertable within an aperture located at the cable end. A distal end of the cable may be recessed within an outer surface of the helmet, for safety during play. When desired, the recessed end may first be connected to the cable handle using a hook, following which the cable may be withdrawn from the helmet, for example.

BRIEF DESCRIPTION OF THE DRAWINGS

The novel features which are characteristic of the invention are set forth in the appended claims. The invention itself, however, together with further objects and attendant advantages thereof, will best be understood by reference to the following description taken in connection with the accompanying drawings, in which:

FIG. 4 is a perspective view of an embodiment of the invention showing a disassembled helmet and a suitable cable;

FIG. 4A is an enlarged view of the guide element circled in FIG. 4;

FIG. 5 is a perspective view of the helmet shown in FIG. 4, now assembled with the cable in place;

FIG. 6 is a front view of the disassembled helmet shown in FIG. 4;

FIG. 7 is a front view of the assembled helmet shown in FIG. 5;

FIG. 8 is an enlarged view of one embodiment of the distal cable portion shown in FIG. 4;

FIG. 9 is an enlarged view of one embodiment of the handle portion of the cable shown in FIG. 4;

FIG. 10 is an enlarged, sectional view of an alternative embodiment of the handle portion of the cable shown in FIG. 4;

FIG. 11 is an enlarged, sectional view of another alternative embodiment of the handle portion of the cable shown in FIG. 4; and FIG. 12 is a perspective view of yet another alternative embodiment of the present invention.

DEFINITION OF THE CLAIM TERMS

Figure 1:
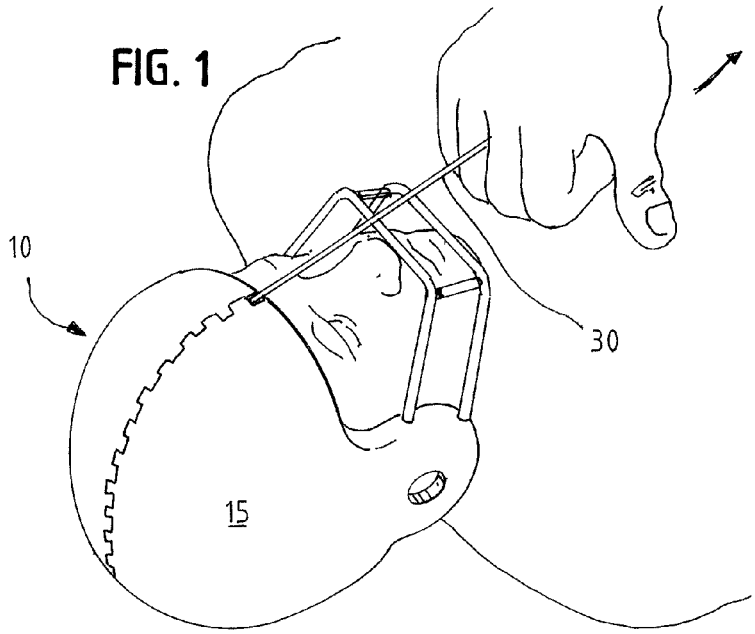
FIGS. 1 and 2 are perspective views of a player wearing a helmet according to the present invention, lying in face-up and face-down positions, respectively.
Figure 2:
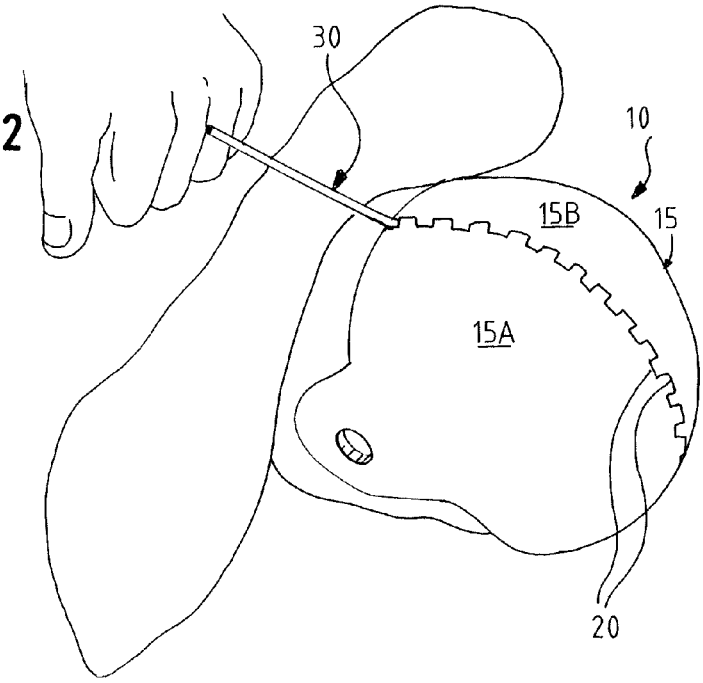

The terms used in the claims of the patent as filed are intended to have their broadest meaning consistent with the requirements of law.

"Cable" means any flexible yet strong element suitable and sized for the purpose intended here, including, without limitation and for exemplary purposes only, conventional cable, steel wire, metal alloys or other similar relatively narrow yet strong materials.

"Heimet" means a head covering of hard or semi-hard or rigid material, such as leather, metal or plastic, or hybrid materials, worn to protect the head.

"Substantial surface length" means a surface length which traverses a majority of the helmet either laterally or longitudinally along either axis.

Where alternative meanings are possible, the broadest meaning is intended. All words used in the claims are intended to be used in the normal, customary usage of grammar and the English language.

DETAILED DESCRIPTION OF THE PREFERRED EMBODIMENTS

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Referring FIGS. 1-2 and 4-7, a helmet in accordance with a preferred embodiment of the invention is generally referred to by reference numeral 10. Helmet 10 includes an outer shell 15 which may, but need not be, rigid. Shell 15 may include a resilient, padded liner (not shown), which may include a cushion and/or foam element. In the example shown, shell 15 includes side portions 15A and 15B which may be split along an axis which traverses a substantial portion of the shell (in this case, the middle of the shell). Mating guide elements 20, which may be made of metal, graphite, hard plastic or a hybrid material, such as shown in FIGS. 4 and 4A, may be positioned in interlocking fashion to the opposing edges of the shell portions, as shown. A flexible cable 30 may then be slidably fit through the apertures 20A in guide elements 20, to interlock the shell portions, enabling the helmet to be rapidly assembled and, if the cable is removed, rapidly disassembled.

Figure 3:
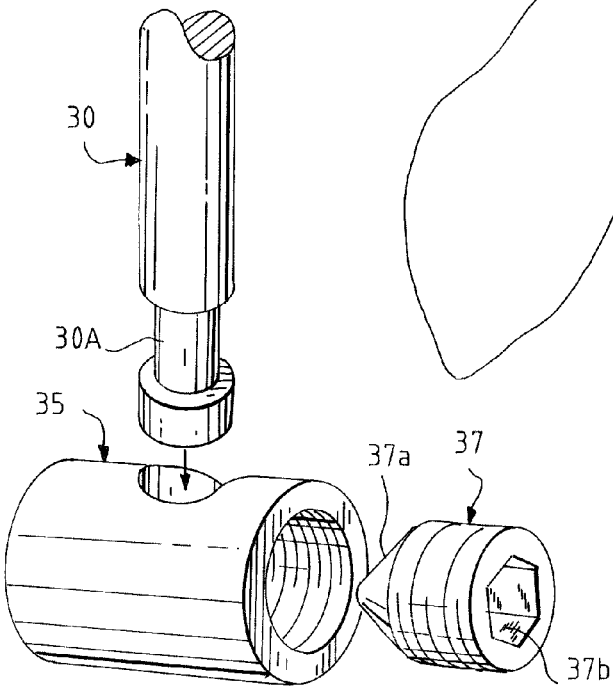
FIG. 3 is an enlarged perspective view of one embodiment of a cable release system.

Cable 30 conveniently has a gripping portion or handle 35, to facilitate cable release from the shell portions. Referring to FIG. 3, to prevent unwanted helmet disassembly, a cable release system may be provided, one embodiment for which is now described. Thus, handle 35 may normally terminate in an end with a recessed portion 30*a*. To release the cable, medical personnel, for example, may insert end 30*a* into the aperture of handle 35, and turn locking element 37 to rigidly attached the handle to the cable. Locking element 37, in one embodiment, may include a cylindrical base with a conical end 37*a* designed to interface with and retain narrowed cable element 30*a* insertable within the handle 35. Locking element 37 may also include an engagement end 37*b* having an opening shaped so that it may be entered and turned only by insertion of a special key (not shown). Handle 35 and locking element 37 may be covered with a protective covering, such as a rubber sleeve, to prevent injury to opposing players as well as to possibly prevent tampering by opposing players, as further explained below.

In an alternative embodiment, each end of cable 30 may be provided with a handle 35 and/or a cable release mechanism, as shown in FIGS. 5 and 7, to allow helmet release of a player lying face-up or face-down, without first having to turn the player over.

Referring now to FIGS. 4-11, another embodiment of the invention is shown. In this embodiment, cable 30 may be provided with a main portion 31*a* and a threaded end 31*b* having a reduced thickness, as shown in FIG. 8. This may allow the cable to be more easily threaded through apertured hinges 20. Referring to FIGS. 9 and 10, handle 35 may be covered with a protective rubber sleeve 41, which may frictionally engage handle 35 and/or be loosely threaded on, while still allowing sleeve 41 to be slid off under pressure if, for example, medical personnel are attempting to remove a cable having opposing handles. Thus, referring to FIG. 7, assuming each handle 35 is covered with a sleeve 41, if either sleeve 41 is pulled, the opposing end's sleeve will drop off, allowing the cable to be removed to release the helmet. Referring to FIG. 11, in an alternative embodiment, a handle 43 may be crimped or otherwise attached to sleeve 41, providing medical personnel, for example, with extra leverage to remove the cable in exigent circumstances.

Referring now to FIG. 12, yet another alternative embodiment of the invention is shown. Here, a distal end of the cable 30' may terminate in an end having a suitably-sized aperture 66. The distal end of the cable may be recessed within the helmet, so as not to cause injury during play, and may also be covered by a rubber tip or grommet 68. If the helmet must be disassembled, medical personnel may employ handle 35 having a hook 67 sized to be inserted within aperture 66; thus hooked, the cable may not be released by pulling on the handle. This embodiment allows medical personnel to disassemble the helmet using rudimentary mechanism they are likely to have on hand, rather than a special key which may be lost.

Other changes and modifications constituting insubstantial differences from the present invention, such as those expressed here or others left unexpressed but apparent to those of ordinary skill in the art, can be made without departing from the spirit and scope of the present invention and without diminishing its attendant advantages. It is, therefore, intended that such changes and modifications be covered by the following claims.

I claim:

1. A helmet which may be rapidly disassembled and removed from a wearer, and then immediately reused, comprising:

an outer shell split along at least one axis which traverses a substantial surface length of the shell, the shell having cable fastening elements positioned along the split area;

a flexible cable for engaging the cable fastening elements positioned along the split area so that when the cable is inserted through the cable fastening elements, the outer shell is formed into an integral, rigid unit, wherein the cable comprises at least one handle facilitating removal of the cable from the shell, and wherein the handle is removably attached to at least one end of the cable using a cable release mechanism, operable by the use of a key;

wherein the end of the cable when not attached to the removable handle is recessed within and not protruding from an outer surface of the helmet;

wherein following cable disengagement from the cable fastening elements, the outer shell is rapidly disassembled and may be removed from the wearer and, following disassembly, when the cable reengages the cable fastening elements, the outer shell is rapidly reassembled.

2. The helmet of claim 1, wherein the cable release mechanism comprises a locking element designed to allow the handle to be rigidly connected to an end of the cable upon operation of the key, and which permits the handle to be released from the cable also upon operation of the key.

3. The helmet of claim 1, further comprising a resilient, padded inner liner attached adjacent to the outer shell.

4. The helmet of claim 1, wherein the cable fastening elements comprise hollow, generally cylindrical-shaped elements spaced along the split area, and positioned so that fastening elements located on opposing sides of the split area lie adjacent to each other when the helmet is assembled.

5. The helmet of claim 3, wherein the outer shell comprises two or more separate portions, and the liner comprises two or more separate pieces, with each liner piece sized and shaped to line a separate portion of the outer shell.

6. The helmet of claim 1, wherein the at least one axis comprises an axis which splits the helmet into two side portions.

7. The helmet of claim 1, wherein the at least one axis comprises an axis which splits the helmet into front and rear portions.

8. The helmet of claim 1, wherein the at least one handle is covered by a rubber sleeve.

9. The helmet of claim 1, wherein at least one end of the cable is covered by a sleeve.

10. A helmet which may be rapidly disassembled and removed from a wearer, and then immediately reused, comprising:

an outer shell split along at least one axis which traverses a substantial surface length of the shell, the shell having cable fastening elements positioned along the split area;

a flexible cable for engaging the cable fastening elements positioned along the split area so that when the cable is inserted through the cable fastening elements, the outer shell is formed into an integral, rigid unit;

wherein the cable includes at least one handle removably attached to at least one end of the cable, the handle facilitating withdrawal and release of the cable from the helmet;

wherein following cable disengagement from the cable fastening elements, the outer shell is rapidly disassembled and may be removed from the wearer and, following disassembly, when the cable reengages the cable fastening elements, the outer shell is rapidly reassembled;

wherein the end of the cable when not attached to the removable handle is recessed within and not protruding from an outer surface of the helmet.

11. The helmet of claim 10, wherein both ends of the cable are recessed within an outer surface of the helmet.

12. The helmet of claim 11, wherein the recessed end of the cable is connected to the handle using a hook.

13. The helmet of claim 10, wherein the handle is rigidly connected to the end of the cable upon operation of the key, and which permits the handle to be released from the cable also upon operation of the key.

* * * * *